United States Patent [19]

Masters

[11] Patent Number: 4,681,060

[45] Date of Patent: Jul. 21, 1987

[54] KAYAK FRAME SECTION AND METHOD

[76] Inventor: William E. Masters, 313 Dogwood La., Easley, S.C. 29640

[21] Appl. No.: 784,728

[22] Filed: Oct. 7, 1985

[51] Int. Cl.[4] ..... B63B 35/72

[52] U.S. Cl. ..... 114/347; 114/357; 114/359; 114/83

[58] Field of Search ..... 114/343, 347, 352–359, 114/68, 69, 83, 77 R, 78

[56] References Cited

U.S. PATENT DOCUMENTS

| | | | |
|---|---|---|---|
| 4,057,865 | 11/1977 | Trautwein | 114/347 |
| 4,227,272 | 10/1980 | Masters | 114/347 |
| 4,229,850 | 10/1980 | Arcouette | 114/347 |
| 4,407,216 | 10/1983 | Masters | 114/347 |
| 4,480,579 | 11/1984 | Masters | 114/347 |
| 4,489,028 | 12/1984 | Masters | 114/347 |

*Primary Examiner*—Joseph F. Peters, Jr.
*Assistant Examiner*—C. T. Bartz
*Attorney, Agent, or Firm*—Cort Flint

[57] ABSTRACT

A frame section (20, 22) and method for a high performance flexible skin hull (12) of a kayak (10) is disclosed as including a thin moment resisting web (A) having dimensional rigidity in a vertical direction to resist bending moments surrounded by foam blocks (B) to provide dimensional rigidity in a lateral direction to prevent buckling of the web under stress. The composite weight of the frame section is light enough to not alter hull performance.

20 Claims, 7 Drawing Figures

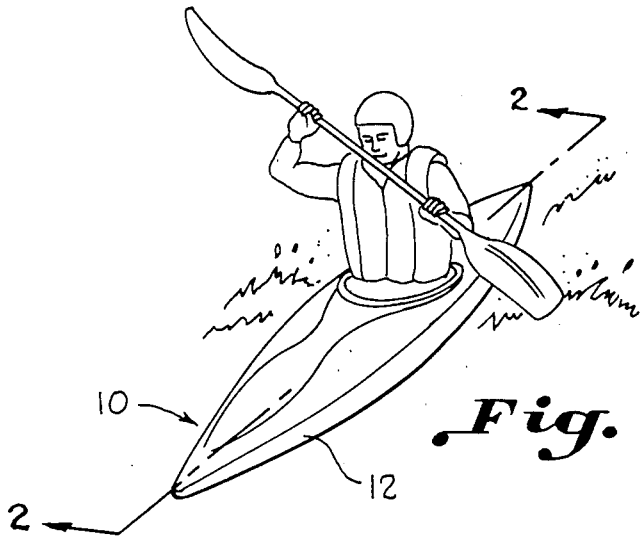
Fig. 1.
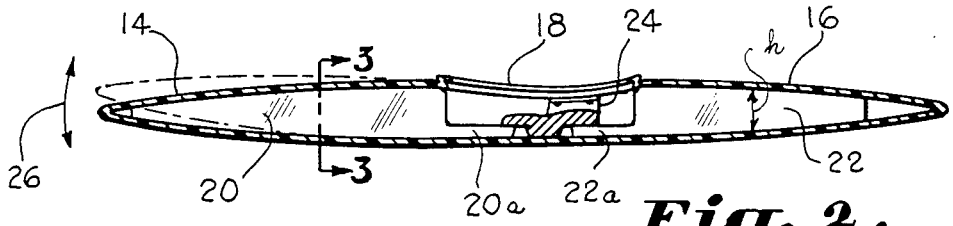
Fig. 2.
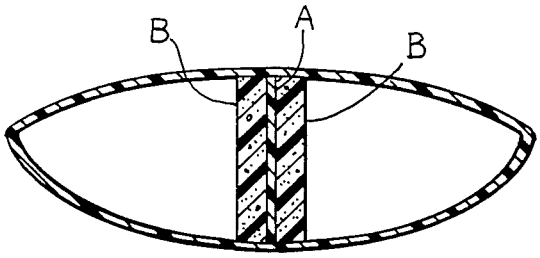
Fig. 3-A.
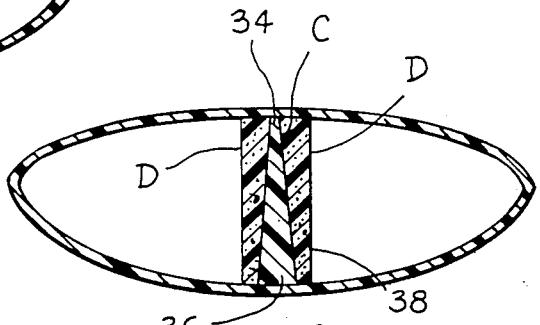
Fig. 3-C.
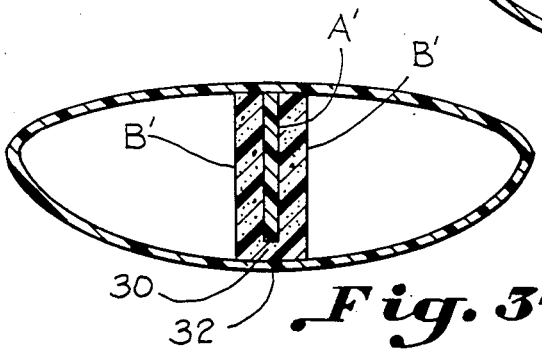
Fig. 3-B.

KAYAK FRAME SECTION AND METHOD

BACKGROUND OF THE INVENTION

The invention relates to an internal frame for a flexible kayak hull, and, particularly, a frame section having increased resistance to bending moments in a pitch direction while being laterally stable. While not limited thereto, these kayaks are designed for whitewater conditions, and so that some amount of flexure is inherent in the kayak structure for impact against rocks, boulders, and the like. However, lightweight frame sections are required in the bow and stern of the hull for proper performance. If the frame section is too heavy, the bow or stern becomes too heavy and the kayak looses its responsiveness. That is, due to the weight, for example in the bow, the kayak does not steer or turn quickly, making it hard to maneuver in whitewater.

Internal framework has been provided before in kayaks having flexible hull skins such as in U.S. Pat. No. 4,227,272 wherein a molded bow and stern frame section is disclosed; and in U.S. Pat. No. 4,407,216, both of which are issued to the same inventor herein. It has also been known to construct internal framework for flexible kayak hulls by forming the frame sections from solid resilient foam blocks.

The problem arises that as kayak hulls have developed, they have become more shallow for higher speed and peformance. The height of the hull has decreased resulting in a decrease in the height of the internal frame sections in the bow and stern of the hull. This decreased height of the frame sections has resulted in lightweight frame sections of insufficient strength to withstand bending moments in the pitch direction encountered under severe whitewater and other conditions of high dynamic stress. Using heavier, more dense materials may not be acceptable due to the weight limitations for performance.

Accordingly, an object of the present invention is to provide an internal frame section for the hull of a kayak constructed from a flexible skin enclosure.

Another object of the present invention is to provide a frame section for a flexible kayak hull having increased resistance to bending moments in a pitch direction yet which is sufficiently light weight as not to influence the performance of the kayak.

Another object of the invention is to provide an internal frame section for a flexible hull enclosure of a kayak, and the like, having increased resistance to bending moments in a pitch direction yet which is light weight and resists buckling in a lateral direction.

Another important object of the present invention is to provide an internal frame section for a flexible kayak hull which is constructed as a thin web stiffening member which effectively resists bending moments in a pitch direction, having block foam material laminated on each side to prevent buckling or warping in a lateral direction.

SUMMARY OF THE INVENTION

The above objectives are accomplished according to the present invention by providing a frame section for the bow and stern sections of a flexible hull constructed from a thin polyethylene flexible skin enclosure in which the frame sections are located. A method of providing a shallow hull having increased resistance to bending moments in the pitch direction includes providing the frame sections in the form of a thin plastic web having increased resistance to bending moments in a pitch direction, and which is surrounded by lightweight foam blocks on each side in a manner in which lateral buckling of the thin web member is effectively prevented as it undergoes compressive and tensile forces.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a perspective view illustrating a shallow hull kayak constructed from a flexible skin enclosure provided with increased resistance to bending moments in a pitch direction according to the invention;

FIG. 2 is a sectional view taken along line 2—2 of FIG. 1;

FIGS. 3A, 3B, and 3C are alternate embodiments of a cross-section of a frame section taken along line 3—3 of FIG. 2 showing various embodiments of a frame section having increased resistance to bending moments in a pitch direction, and in which reduced lateral buckling of a thin web moment resisting member is prevented;

DESCRIPTION OF A PREFERRED EMBODIMENT

Figure 4:
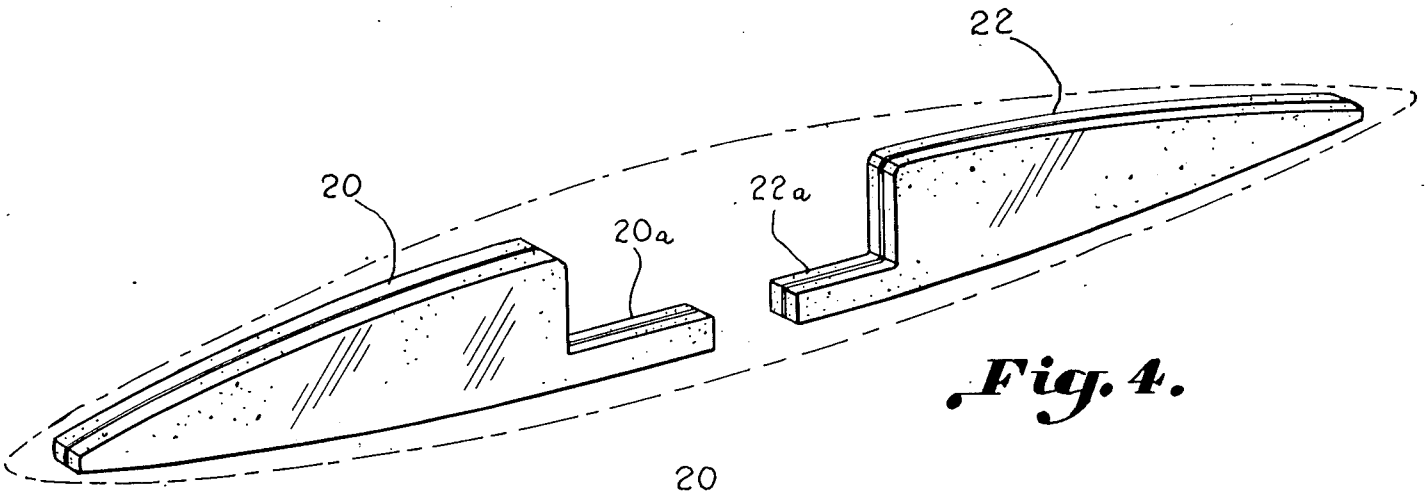
FIG. 4 is a perspective view illustrating bow and stern frame sections constructed in accordance with the present invention.

Referring now in more details to the drawings, a kayak illustrated generally at 10 has a hull 12 constructed from a flexible skin enclosure, for example, polyethylene or other suitable plastic material such as disclosed in U.S. Pat. No. 4,227,272. The hull enclosure includes a bow section 14, stern section 16, and a central seat opening 18. Inside of the flexible skin enclosure is a longitudinal frame section 20 located in the bow section, and a longitudinal frame section 22 located in the stern section. Frame sections 22 and 20 have a longitudinally tapered height profile, h, in accordance with the design and shape of bow and stern hull sections 14 and 16. Each frame section may include an extension 20*a* and 22*a* which fits underneath a molded seat 24 in central seat opening 18. The frame sections may hinge generally underneath seat 24 when a boater is seated on the seat 24. It is to be understood, of course, that the invention may be used with a number of frame arrangements for boats and kayaks. This enables the flexible hull kayak to withstand the rigorous dynamic forces encountered during whitewater and other boating conditions. In practice, a number of suitable fasteners are utilized to fasten the skin of top and bottom portions of the hull to frame sections 20 and 22.

In accordance with the invention, bow and stern frame sections 20 and 22 are illustrated as including a generally rigid moment-resisting web means in the form of a thin web member A with a generally flexible foam block B secured to either side of the thin web member. In accordance with the method of the present invention, internal frame sections 20 and 22 are constructed so that the thin web member A is sufficiently rigid in the pitch direction, as shown by arrow 26, to effectively resist bending moments when the tapering height, h, of the frame section has been reduced to fit internally within a shallow hull kayak. The lateral buckling forces that would otherwise tend to warp or buckle the thin web member A, as can best be seen in FIG. 5, under bending moments are effectively resisted by foam blocks B adhered or laminated to each side of thin web member A. Most importantly, however, the weight of the frame sections is not increased enough to alter the performance of the hull.

In a preferred embodiment, thin web member A is a thin plate of ABS plastic having a dimension of about one-eighth of an inch. Foam blocks A are polyethylene foam blocks having a width of about one and one-half inches. Any suitable contact cement or heat weld method may be utilized to adhere or laminate the foam blocks and thin plastic web together. The glue line of the foam blocks and plastic web together provide highly effective resistance against shear in the direction of bending. The overall combination provides a frame section having a beam effect which is sufficiently strong to resist bending moments and without lateral warping of bending moment resisting web A. The frame section has a width which is sufficiently wide to accommodate the buckle resisting foam block, yet which is light weight owing to the presence of the foam blocks so that the bow and stern sections are not too heavy for high speed and quick steering of the kayak. If the plastic web were of a sufficient width to prevent lateral buckling or warping, the total resultant weight of the plastic frame section would be too heavy for the bow and stern ends of a lightweight kayak as constructed herein.

FIG. 3B illustrates an alternate embodiment of the invention wherein a thin plastic web A′ is utilized between two blocks of generally flexible foam material B′. In this instance, the thin plastic web member A′ terminates short of the foam blocks B′ where a bottom bridge portion of foam 30 cushions the bottom edge of web member A′ and a bottom 32 of the hull section. This effectively aids in resisting abrading of the flexible skin material at the bottom 32 of the hull as might occur when the kayak impacts boulders, and the like, encountered during whitewater conditions. The bridge cushion reduces impact forces on thin web member A′ and bending moments in the pitch direction.

Referring now to FIG. 3C, an alternate embodiment of the invention is illustrated wherein a plastic web member C is illustrated with foam blocks D on each side. The generally rigid plastic web member C is shown in a triangular cross-sectional shape. The foam blocks D are wider at the top than at the bottom. Other variations of this arrangement may also be utilized in order to accomplish the desired results. During bending in the pitch direction, as shown in dotted lines in FIG. 2, compressive forces will be concentrated at the top edge 34 of web member C and tension forces will be encountered at a bottom edge 36 of web C. The compressive forces at edge 34 will tend to make top edge 34 wavy. The wide sections of foam blocks D adjacent top edge 34 will effectively reinforce web member C and prevent warping of web member C where the compressive forces are the greatest. Likewise, the additional material at 36 in web member C will add to its strength under tension during bending. Foam blocks D contain less material at 38 since the material is not needed in this area to resist the tension forces. It is to be understood that other configurations may also be utilized such as a straight web member having parallel sides and foam blocks which are wider at the top resulting in an overall V-shaped configuration.

Figure 5:
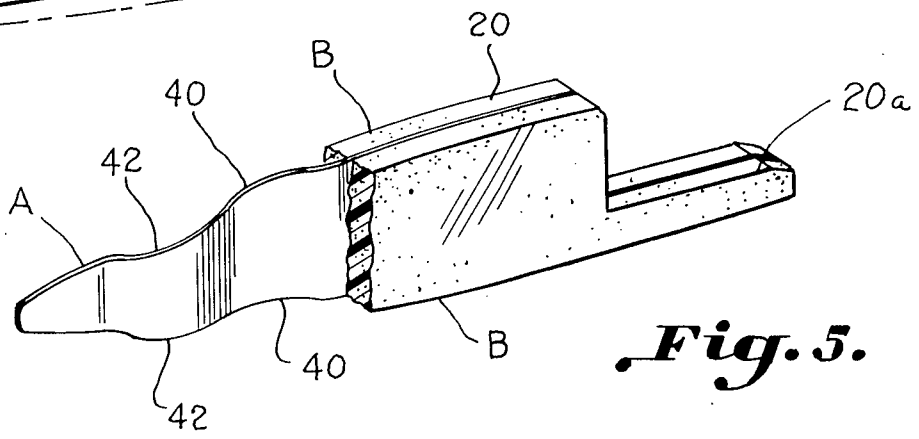
FIG. 5 is a perspective view of the bow frame section of FIG. 4 with part of a foam block cut away to illustrate the thin web moment resisting member.

Referring to FIGS. 4 and 5, the overall configuration of frame sections 20, 22 constructed in accordance with the invention are illustrated. Thin web member has sufficient dimensional rigidity in the vertical direction corresponding to h to effectively resist bending moments in the pitch direction, and thinness is desired for lightness. However, due to its thinness, the web has no dimensional stability in the lateral direction. Foam blocks B or D provide this rigidity without going beyond a prescribed weight limit which would alter hull performance. In FIG. 5, the buckling effect of bending moments on thin web member A is illustrated wherein web member A is warped at 40 and 42. Web member A has dimensional stability much like the blade of a conventional hand saw. When foam blocks B are glued to the sides of web member A, the lateral warping or buckling is effectively prevented, while the weight of the frame section is not significantly increased.

It is to be understood that several web members A, A′, or C may be arranged in a composite beam member in accordance with the invention, in which case a foam block will be on each side of each web.

While a preferred embodiment of the invention has been described using specific terms, such description is for illustrative purposes only, and it is to be understood that changes and variations may be made without departing from the spirit or scope of the following claims.

What is claimed is:

1. A method of constructing a frame section for a high performance kayak having a flexible hull constructed from a flexible skin enclosure wherein bending moments in a pitch direction are effectively resisted without significantly increasing its weight, said kayak being of the type having longitudinal frame sections located internally in the bow and stern portions of the flexible hull enclosure, said method comprising the inclusion in said frame sections of a generally rigid thin web member which effectively resists bending moments in a pitch direction, and including on each side of said thin web member a generally resilient lightweight foam block affixed to said web member which effectively reduces lateral buckling and warping of said thin web member under bending moments while providing a composite frame section which is within prescribed weight limitations to maintain the performance of the hull.

2. The method of claim 1 including constructing said frame section by making said generally rigid web member narrower at the top than at the bottom.

3. The method of claim 1 wherein said generally rigid thin web member is included in said frame section such that said foam blocks included on either side of said thin web member are wider at a top portion than at a bottom portion of said foam blocks.

4. The method of claim 1 wherein said thin web member is included in said frame section in a manner in which said web member terminates short of a bottom of said frame section and a cushion of said foam material is disposed between said web member and a bottom of said kayak hull.

5. The method of claim 1 wherein said thin web member is included as a plate of generally rigid plastic material having rigidity in a vertical dimension and flexibility in a lateral direction.

6. The method of claim 5 wherein said rigid plastic web member and said resilient foam blocks are adhered together by glueing or heat welding.

7. The method of claim 1 wherein said thin web member and each of said foam blocks has a width ratio of approximately 1:10.

8. A method of constructing an internal lightweight frame section for a shallow high performance hull for a kayak without significantly adding to weight, said kayak hull being of the type which includes a flexible plastic skin enclosure having a bow section, a stern section, and central seat section, a longitudinal frame section located in said bow and hull section having a longitudinally tapering contour which follows a tapering height of said shallow hull wherein the method comprises providing a moment resisting thin web member having dimensional rigidity in a vertical direction for resisting bending moments in a pitch direction, said thin web member having dimensional flexibility in a direction transverse to said vertical direction; and affixing a lightweight foam block to each side of said thin moment resisting web member to provide stability and rigidity to said thin web member in said transverse direction so that lateral buckling and warping of said thin web member is reduced while resisting bending moments in said pitch direction and said frame section has a composite weight within prescribed limitations for the hull performance.

9. The method of claim 8 wherein said thin web member and said foam blocks are affixed together by glueing or heat welding, forming a highly effective glue line which resists shearing in said pitch direction.

10. The method of claim 8 wherein said thin web member is included in said frame section in a manner such that it terminates short of said foam blocks on each side of said web member to provide a foam cushion between said thin web member and a bottom portion of said hull.

11. The method of claim 8 wherein said thin web member is included in said frame section in such a manner that said thin web member is wider at a bottom portion thereof than at a top portion of said web member.

12. A lightweight frame section for a high performance kayak hull and the like having increased bending moment resistance without significant weight increase comprising an elongated generally rigid moment resisting web means being generally rigid in a vertical dimension corresponding to a pitch direction of said hull for resisting bending moments in said pitch direction, said thin web means having lateral flexibility in a lateral dimension transverse to said vertical dimension; and lightweight resilient foam blocks affixed to each side of said moment resisting web means in a manner such that web means effectively resists bending moments in said pitch direction while said foam blocks resist lateral buckling and warping of said web member in said lateral dimension so that the modulus of bending of said hull is increased without significantly altering its weight and performance.

13. The frame section of claim 12 wherein said frame section extends from adjacent a top of said hull to adjacent a bottom of said hull along a substantial length of said hull section, and said thin web means is narrower in its lateral dimension adjacent a top portion of said hull than at a bottom portion of said hull along said length.

14. The frame section of claim 12 wherein said thin web means terminates in said frame section extending generally short of a bottom portion of said hull section and a layer of foam material located in said frame section between said web means and said bottom portion of said hull to provide a foam cushion therebetween.

15. A method of constructing a frame section for a high performance kayak having a flexible hull constructed from a flexible skin enclosure wherein bending moments in a pitch direction are effectively resisted without significantly increasing the weight of said kayak, said kayak being of the type having longitudinal frame sections located internally in the bow and stern portions of the flexible hull enclosure, said method comprising the steps of:

(a) preparing a rigid, thin web member in the shape desired for said frame section;

(b) preparing at least one generally resilient lightweight foam block which conforms to the shape of said web member; and (c) affixing said resilient foam block to said web member, whereby lateral doubling and warping of said web member under bending moments is reduced while providing a composite frame section which is within prescribed weight limitations to maintain the performance of the hull.

16. The method of claim 15, including affixing two resilient lightweight foam blocks to said web member, each of which conforms to the shape of said web member and one of which is affixed to each side of said web member.

17. The method of claim 15, wherein the preparation of said web member includes making said web member narrower at the top than at the bottom.

18. The method of claim 15, wherein said foam block is wider at a top portion than it is at a bottom portion of said web member.

19. The method of claim 16, wherein said thin web member is composed of a generally rigid plastic material having a rigidity in its vertical dimension and flexibility in its lateral direction.

20. The method of claim 15, wherein said resilient foam blocks are affixed to said web member by gluing or heat bonding.

* * * * *